US005136920A

United States Patent [19]

Breed et al.

[11] Patent Number: 5,136,920

[45] Date of Patent: Aug. 11, 1992

[54] WATER CANNON FOR NEUTRALIZING EXPLOSIVE DEVICES, AND REPLACEABLE CARTRIDGE THEREFOR

[75] Inventors: Allen K. Breed, Boonton Township, Morris County; Herman Stoeckle, Newfoundland; Donald Tuttle, Jr., Morristown, all of N.J.

[73] Assignee: Custom Engineering and Design, Inc., Boonton Township, Morris County, N.J.

[21] Appl. No.: 620,278

[22] Filed: Nov. 30, 1990

Related U.S. Application Data

[62] Division of Ser. No. 557,530, Jun. 24, 1990, abandoned.

[51] Int. Cl.[5] ..... F42B 33/00

[52] U.S. Cl. ..... 86/50; 102/430; 102/502

[58] Field of Search ..... 86/50; 102/430, 502, 102/439, 202.11

[56] References Cited

U.S. PATENT DOCUMENTS 3,613,592 10/1971 Brown ..... 102/220
3,785,293 1/1974 Barr et al. ..... 102/529

FOREIGN PATENT DOCUMENTS 2907859 6/1982 Fed. Rep. of Germany .
3545737 2/1987 Fed. Rep. of Germany .
2083894 1/1981 United Kingdom .

*Primary Examiner*—J. Woodrow Eldred
*Attorney, Agent, or Firm*—Kane, Dalsimer, Sullivan, Kurucz, Levy, Eisele and Richard

[57] ABSTRACT

A water cannon assembly is described which includes a stand used to support and air a water cannon, and a replaceable cartridge which may be placed in the cannon. When the cartridge is set off, the cannon shoots out a concentrated liquid jet which may be used to disable the detonator of an explosive device, such as a bomb. The stand may have a base suitable for a hard flat surface, or it may include a spike for positioning the cannon on soft ground.

9 Claims, 5 Drawing Sheets

WATER CANNON FOR NEUTRALIZING EXPLOSIVE DEVICES, AND REPLACEABLE CARTRIDGE THEREFOR

This is a divisional of copending application Ser. No. 07/557,530 filed on Jun. 24, 1990, now abandoned.

BACKGROUND OF THE INVENTION a. Field of Invention

This invention pertains to water cannons, and more particularly to a portable water cannon kit used for neutralizing bombs. The invention also pertains to a water cartridge used for the same.

b. Description of the Prior Art

A technique has been developed over the past few years for neutralizing active bombs using a concentrated high pressure water jet. The technique involved filling a tube with water, placing the tube in a barrel and then forcibly ejecting the water therefrom using an explosive charge. The water jet thus generated was directed toward the actual or suspected placement of the detonator to displace and disconnect it from the explosive. However, the prior art devices constructed so far were unreliable and difficult to aim and operate. Furthermore, in cold weather they were prone to freezing.

OBJECTIVES AND SUMMARY OF THE INVENTION

In view of the disadvantages of the prior art, it is an objective of the present invention to provide a water cannon assembly which operates reliably to insure that bombs can be effectively and quickly neutralized.

A further objective is to provide a water canon assembly which can be easily positioned and used under a variety of physical conditions.

Yet another objective is to provide a standardized, reliable water cartridge for a water cannon assembly which may be used even in cold weather.

Other objectives and advantages of the invention shall become apparent from the following description.

Briefly a water cannon assembly constructed in accordance with this invention consists of a stand including a platform which may be vertically movable. The canon may be mounted on the platform and aimed by raising or lowering the platform, and rotating the stand. A replaceable cartridge is disposed in the cannon and it includes a housing which contains a liquid, and liquid ejecting means. With the cartridge in the cannon, and the cannon aimed at the explosive device detonator, when the ejecting means within the cartridge is activated or otherwise set off, a concentrated stream of liquid shoots out of the cannon to deactivate the detonator.

DETAILED DESCRIPTION OF THE INVENTION

Figure 1:
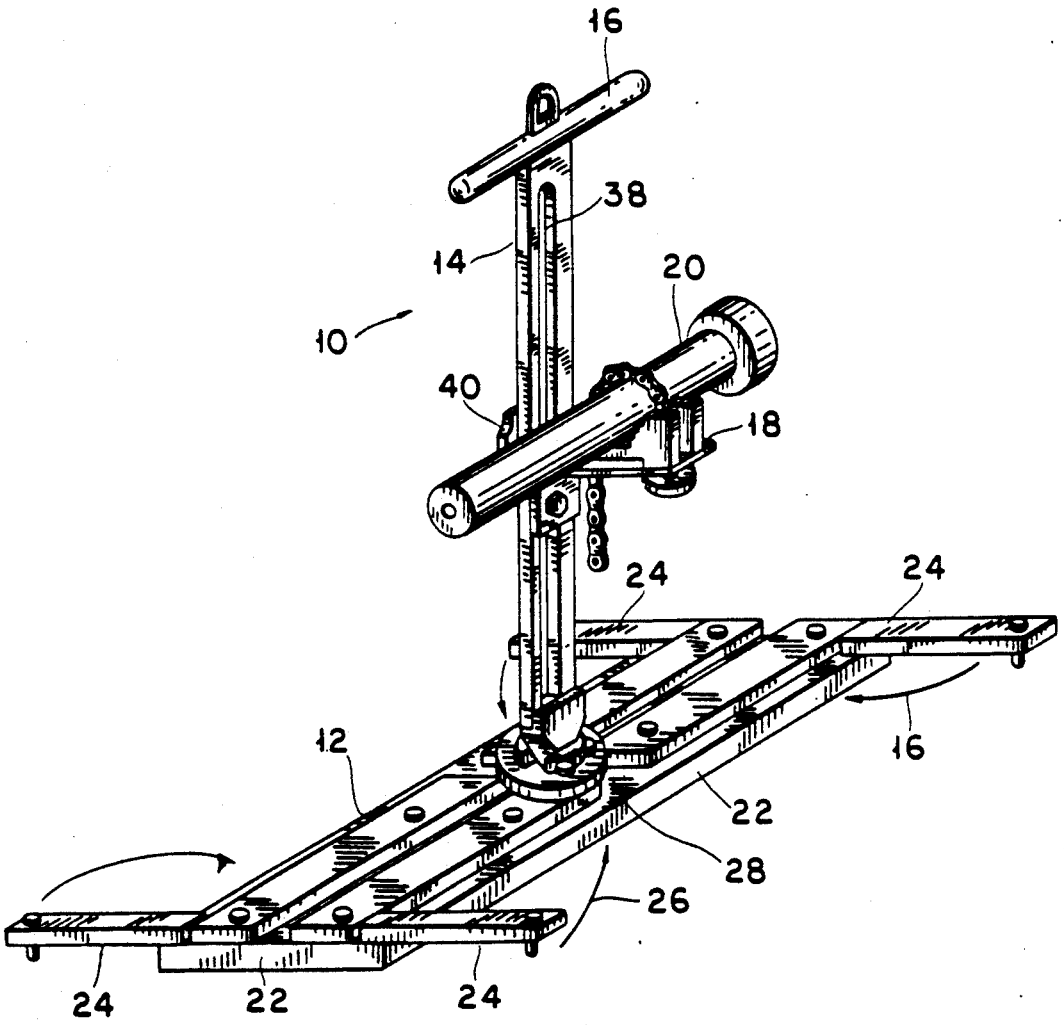
FIG. 1 shows an orthogonal view of a water canon assembly constructed in accordance with this invention.

Referring now to the Figures, an assembly 10 consists of a base 12 with a vertical upright 14 terminating in a transversal handle 16. A platform 18 is mounted reciprocatively in the upright 14 for holding a water cannon 20.

Preferably base 12 consists of a main body 22 and four legs 24 extending laterally from the base to increase the effective support area and stability of the base 12. Legs 24 may be mounted rigidly to main body 22, or alternatively, each leg 24 may be mounted to the body 22 by a pivoting means such as a screw and nut arrangement. In this later configuration, the legs may be folded close to body 22, as shown by arrows 26. In this configuration the assembly 10 occupies less volume, and is easier to store or transport. Base 12 also has a round plate 28 used to secure upright 14 to base 12.

Platform 18 includes an L-shaped bracket 30 having a long horizontal leg 32 and a short vertical leg 34. A bolt 36 passes through a hole (not shown) made in short leg 34 and through longitudinal slot 38 made in upright 14. A handle 40 is screwed on bolt 36 on the other side of upright 14 as shown. The bolt 36 and handle 40 cooperate to allow the platform 18 to be selectively raised or lowered as desired with respect to upright 14 when the handle is loose. When the platform 18, and the water cannon 20 mounted thereon are positioned at a desired height, the platform is secured to the upright 14 by tightening handle 40 on bolt 36. Platform 18 supports a cannon mounting device which may consist for example of a mounting assembly 42 similar to a chain pipe vise. Mounting assembly 42 includes a cradle 44 secured to bracket 30 and having a semicircular opening 46 provided with a plurality of grabbing teeth 48. Mounting assembly 42 further includes a chain 50 with one end 52 secured to cradle 44. The other end 54 of the chain 50 passes over cannon 20 and through openings (not shown) made in the cradle 44 and bracket 30 to extend downward as shown. A knob 56 is used to tighten chain 50 thereby securing the cannon 20 to the platform 18 in the same manner that is used to secure a pipe with a chain pipe vise. The mounting assembly 42 may be mounted on the platform so that the knob is either adjacent to the upright 14, as shown in FIG. 1, or away from it as shown in FIG. 2.

Figure 2:
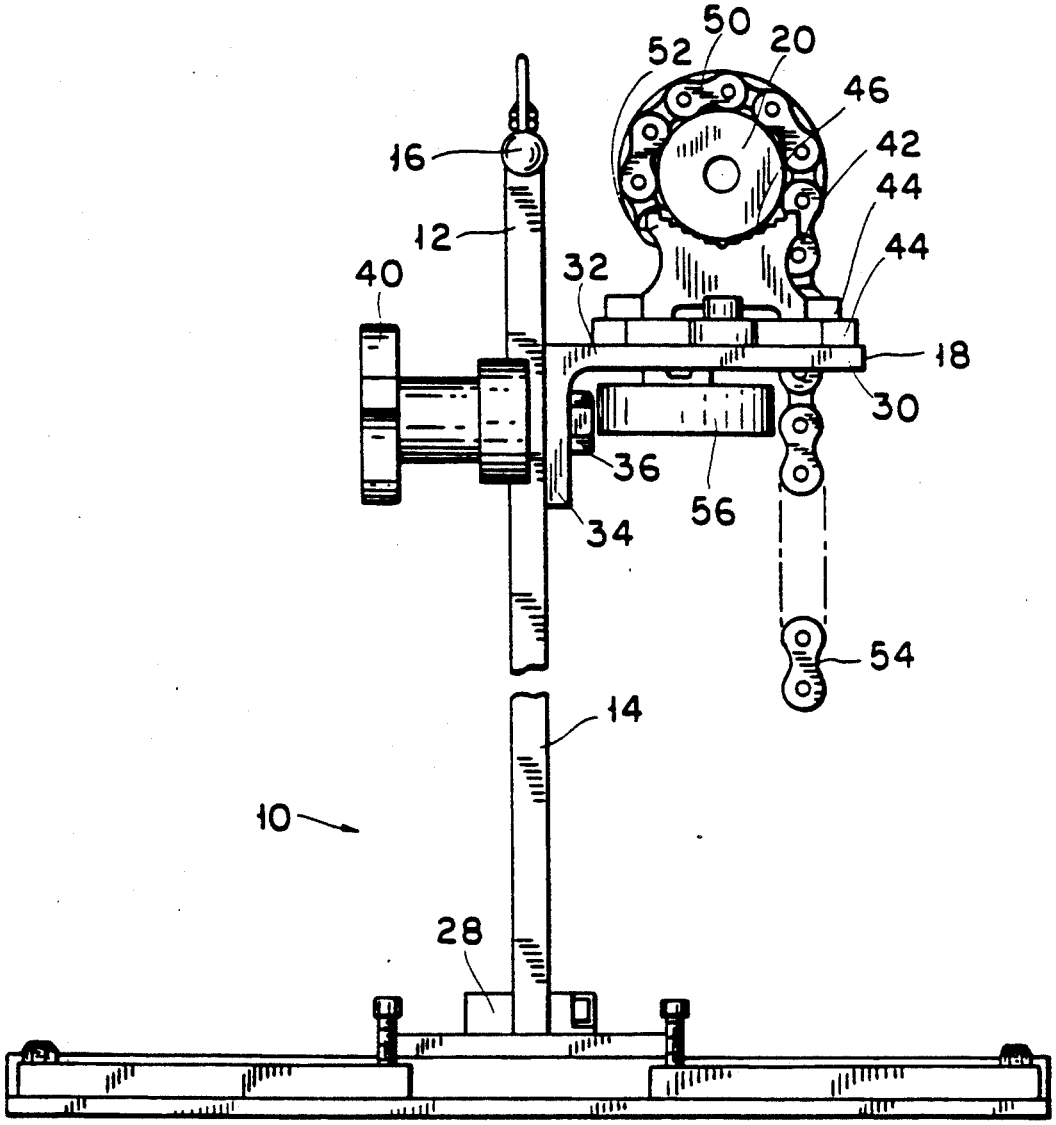
FIG. 2 shows a side view of the assembly of FIG. 1.
Figure 3:
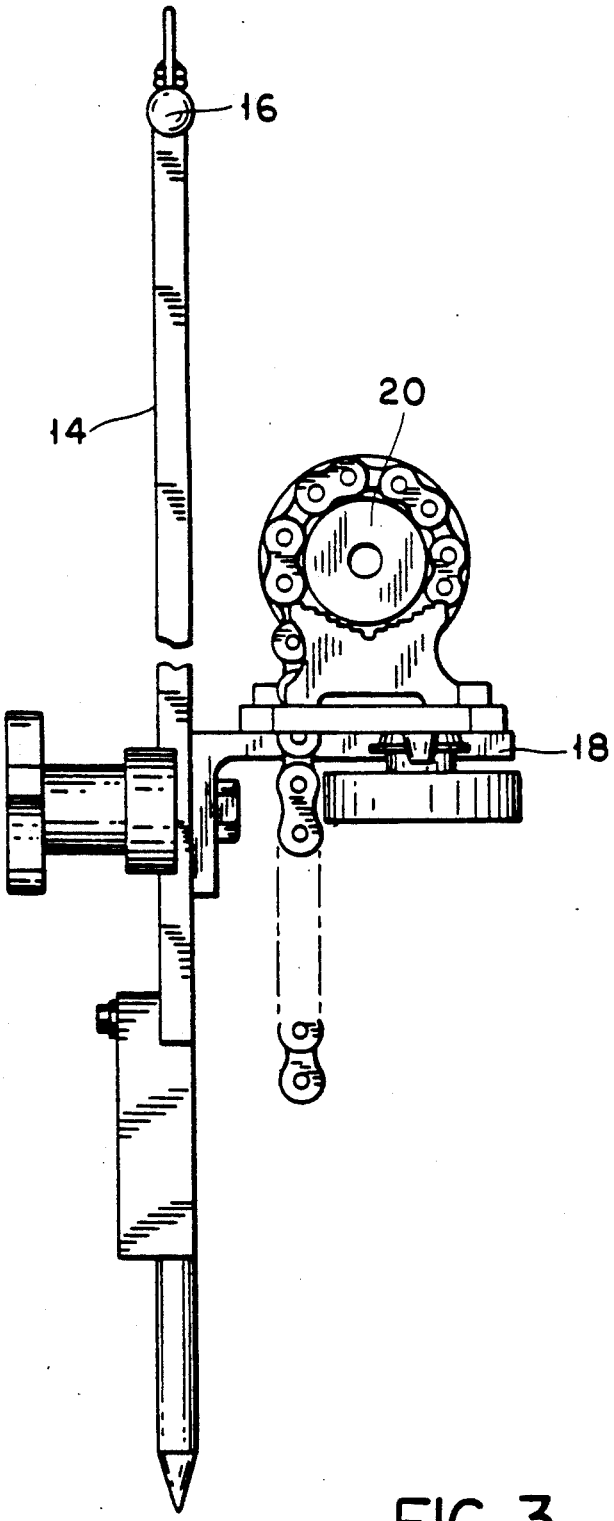
FIG. 3 shows side sectional view of an alternate embodiment of the invention.
Figure 4:
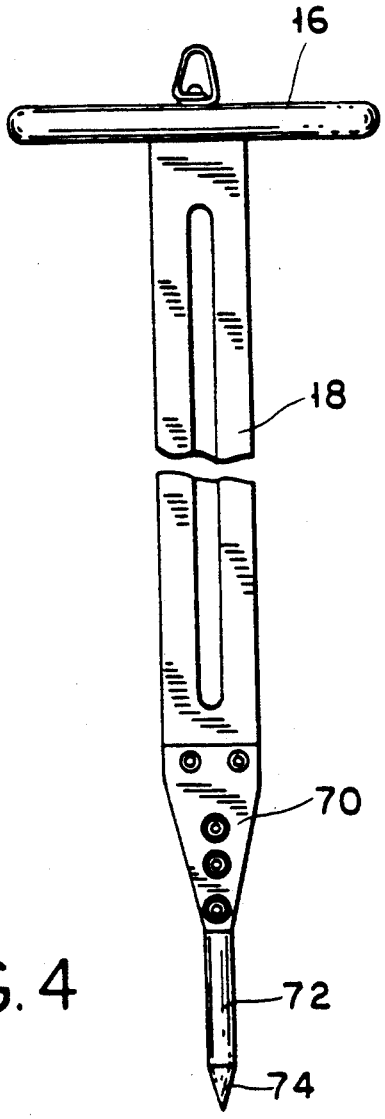
FIG. 4 shows a front view of the upright used in the embodiment of FIG. 3.
Figure 5:
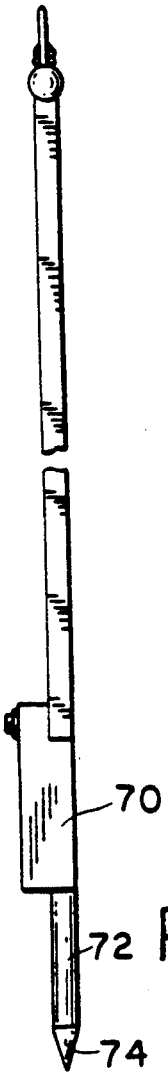
FIG. 5 shows a side view of the upright of FIG. 4.
Figure 6:
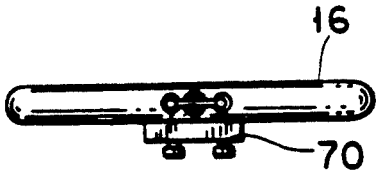
FIG. 6 shows a op view of the upright of FIGS. 4 and 5.

Handle 16 may be used to carry the whole assembly shown in FIGS. 1 and 2 and to position the water cannon. A hoop 58 is provided on top of the handle so that the assembly can be lowered or supported if necessary.

The cannon assembly shown in FIGS. 1 and 2 is best suited to be positioned on a hard surface whereby it achieves stability by opening the legs 24. Another assembly made of similar parts is shown in FIGS. 3-6. This assembly 10, includes an upright 14, with a handle 16 and a reciprocating platform 18 for supporting a water cannon 20 just like in the assembly 10 shown in FIGS. 1 and 2. However in this assembly 10', the upright 12 is secured to triangular plate 70. Plate 70 in turn is secured to an elongated spike 72 terminating in point 74. Assembly 10' is more suited for positioning the cannon on a soft surface, such as grass or dirt, by burying the spike 72.

Figure 7:
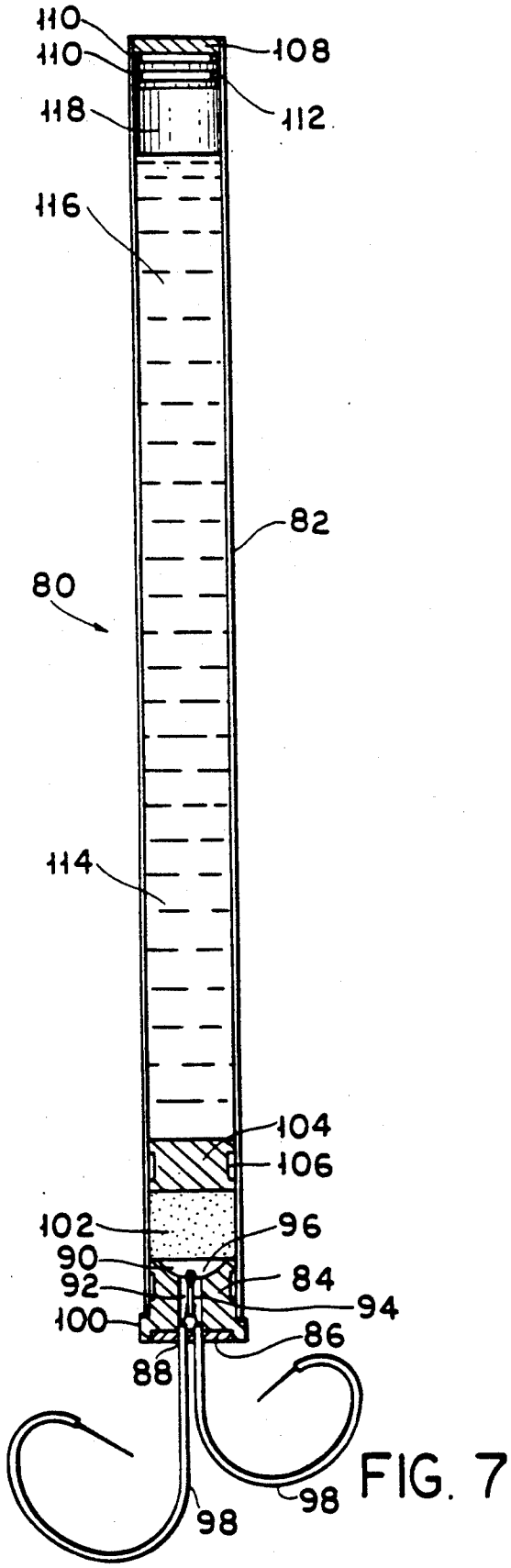
FIG. 7 shows an enlarged side-sectional view of water cartridge constructed in accordance with this invention to be used in the assembly of FIGS. 1-6.

The cannon assemblies described above are used to fire a water cartridge 80 which may be arranged and constructed as shown in FIG. 7. Cartridge 80 includes an elongated cylindrical housing 82 made of plastic material such as polyethylene. At one end the cartridge is closed off with a plug 84 which is also made of polyethylene and is secured to the housing 82 for example by welding. Plug 84 has an end cap 86 made of a strong, rigid material such as brass. End cap 86 is formed with a central hole 88. Plug 84 is formed with a concave inner surface 90 with a hole 92 passing from surface 90 to hole 88 as shown. Surface 90 defines an air space 96. Within hole 92 and extending into air space 96 is an electric match 94 having two leads 98, 98. Match 94 may be for example an M-100 Electric Match made by the I.C.I. Aerospace company of Valley Forge, Pa. The plug 84 has an enlarged crown 100 with a diameter which is slightly larger than the diameter of housing 82. Adjacent to plug 84 and air space 96, the cartridge is loaded with a suitable amount of smokeless gun powder 102 shaped into a cylinder as shown. Adjacent to the gunpowder 102, there is a disk-shaped insert 104 formed with a circumferential groove 106. Preferably insert 10 is also made of plastic polyethylene and is welded in place.

The opposite end of housing 82 there is a front end plug 108 having a plurality of grooves 110, and also made of polyethylene. Preferably plug 108 is crimped in place. To insure that the housing 82 is water tight, an O-ring 112 is disposed in at least one of the grooves 110. Between insert 104 and plug 108, the cartridge 80 is filled with a liquid 114. This liquid 114 may consist for example of a solution of 50/50 water and methanol. This solution has a much lower freezing temperature than water so that the cartridge can be used in cold climates. Of course for warm climates, plain water may be used. Preferably the space 116 between plug 108 and insert 104 is only partially filled with liquid 114 thereby leaving an air space 118 to permit the liquid 114 to thermally expand and contract when the ambient temperature changes. Otherwise, the cartridge may be burst.

Finally, cannon 20 includes a cylindrical barrel 120 threaded as at 122. Preferably, threads 122 are not continuous, but are interrupted. A breech 124 is threadedly mounted on the barrel 120, and is formed with a hole 126. The breech 124 and barrel 120 cooperate to hold and secure a cartridge 80 for example by capturing crown 100 therebetween. Leads 98 can be passed through hole 126. To insure that the breech is mounted on the barrel 120 properly aligning marks 128, 130, are provided. The aligning marks indicate the match between the interrupted thread on the breech and the barrel. The interrupted thread is provided to facilitate loading and unloading the cannon. The thread is designed to permit a one-quarter turn (or less) of the breech to mount or dismount the same from the barrel.

Figure 8:
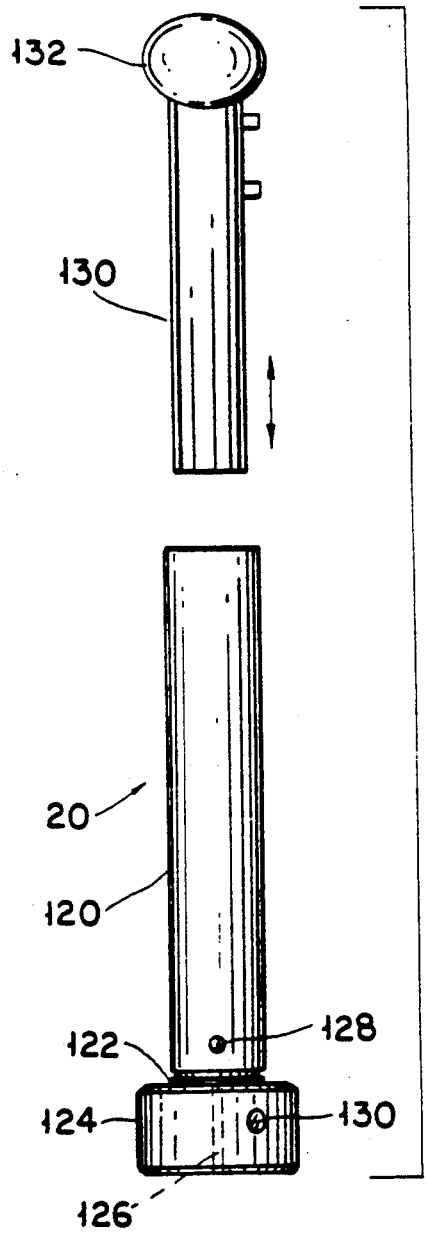
FIG. 8 shows a side view of the water canon itself.

The operation of the assembly is as follows. Base 12 used for a flat surface, (or the base shown in FIGS. 4–6 for a soft surface) upright 14, and platform 18 together form a stand for the cannon 20. The stand is positioned and the platform raised or lowered so that the cannon is pointing toward a target such as the known or suspected position of the detonator of a bomb (not shown). A cannon 20 is positioned on platform 18 and clamped in place by chain 50. Alternatively the cannon can be secured to the platform 18 before the stand is positioned. Preferably the cannon has been preloaded with a cartridge 80 so that once the cannon is mounted and aimed it is ready to be fired. The leads 98 of match 94 are then connected to an electric source such as a battery or hand-held current generator (not shown). Electric current from the source activates match 94 which in turn detonates powder 102. The detonated powder in turn ejects insert 104 out of the barrel which in turn pushes the liquid 114 (and incidently plug 108) out of the barrel, the liquid being shaped into a narrow high pressure stream for deactivating the bomb detonator. Once the cannon is discharged, the breech is removed with the aid of the rod and spanner dowels and the remains of the cartridge can be quickly cleaned out, for example, by pushing a rod 130 into the barrel 120 as shown in FIG. 8. The cannon can then be reloaded with another cartridge 80.

Obviously numerous modifications may be made to this invention without departing from the scope of the invention as defined in the appended claims.

What is claimed is:

1. A replaceable cartridge for use in a water cannon for deactivating an explosive device, said cartridge comprising:

a cylindrical housing having a substantially constant housing inner diameter and terminated by a first end and an opposed second end;

a first plug disposed at said first end;

a second plug disposed at said second end and having a plug outer diameter substantially equal to said housing inner diameter;

a separating insert partitioning said housing into a first cavity defined between said insert and said second plug, and a second cavity defined between said insert and said second plug;

a liquid disposed in said second cavity and consisting of a solution of water and methanol; and ejecting means disposed in said first cavity.

2. The cartridge of claim 1 wherein said ejecting means comprises gun powder and means for selectively setting off said gun powder.

3. The cartridge of claim 2 wherein said selective means comprises an electric match.

4. The cartridge of claim 1 wherein said housing, first plug, and insert are made substantially of plastic.

5. The cartridge of claim 4 wherein said first plug and insert are welded to said housing.

6. The cartridge of claim 1 wherein said second plug is crimped to said housing.

7. The cartridge of claim 1 wherein said second plug includes a plurality of circumferential grooves facing said housing.

8. A replaceable cartridge for use in a water cannon for deactivating an explosive device, said cartridge comprising:

a cylindrical housing having a substantially constant housing inner diameter and terminated by a first end and an opposed second end;

a first plug disposed at said first end;

a second plug disposed at said second end and having a plug outer diameter substantially equal to said housing inner diameter, said second plug having a circumferential groove facing said housing;

a separating insert partitioning said housing into a first cavity defined between said insert and said second plug, and a second cavity defined between said insert and said second plug;

a liquid disposed in said second cavity; and ejecting means disposed in said first cavity.

9. The cartridge of claim 8 further comprising an O-ring disposed in said groove.

* * * * *